US010081856B2

(12) United States Patent
Rafetzeder

(10) Patent No.: US 10,081,856 B2
(45) Date of Patent: Sep. 25, 2018

(54) METHOD FOR PRODUCING COMPLEX FORMED CASTINGS AND CASTING CONSISTING OF AN ALCU ALLOY

(71) Applicant: Nemak, S.A.B. de C.V., Garcia (MX)

(72) Inventor: Michael Rafetzeder, Rohr im Kremstal (AT)

(73) Assignee: Nemak, S.A.B. de C.V., Nuevo Leon (MX)

( * ) Notice: Subject to any disclaimer, the term of this patent is extended or adjusted under 35 U.S.C. 154(b) by 0 days.

(21) Appl. No.: 15/545,062

(22) PCT Filed: Jan. 21, 2016

(86) PCT No.: PCT/IB2016/000036
§ 371 (c)(1),
(2) Date: Jul. 20, 2017

(87) PCT Pub. No.: WO2016/116805
PCT Pub. Date: Jul. 28, 2016

(65) Prior Publication Data

US 2017/0362690 A1 Dec. 21, 2017

(30) Foreign Application Priority Data

Jan. 21, 2015 (EP) ..... 15151960

(51) Int. Cl.

| | |
|---|---|
| ***C22F 1/057*** | (2006.01) |
| ***C22F 1/00*** | (2006.01) |
| ***C21D 1/667*** | (2006.01) |
| ***B22D 21/00*** | (2006.01) |
| ***C22C 21/12*** | (2006.01) |

(52) U.S. Cl.
CPC ..... *C22F 1/057* (2013.01); *B22D 21/007* (2013.01); *C21D 1/667* (2013.01); *C22C 21/12* (2013.01); *C22F 1/002* (2013.01)

(58) Field of Classification Search
CPC ..... C22F 1/057; C22C 21/12
See application file for complete search history.

(56) References Cited

U.S. PATENT DOCUMENTS

| | | | |
|---|---|---|---|
| 2002/0000304 | A1 | 1/2002 | Kahn et al. |
| 2016/0303647 | A1 | 10/2016 | Calin et al. |

FOREIGN PATENT DOCUMENTS

| | | | |
|---|---|---|---|
| DE | 10222098 | A1 | 11/2003 |
| DE | 102004015649 | B3 | 8/2005 |
| DE | 102008015856 | A1 | 10/2009 |
| DE | 102010022343 | A1 | 12/2011 |
| DE | 102014102724 | A1 | 6/2015 |
| EP | 1155763 | A1 | 11/2001 |
| JP | 1017975 | A | 1/1998 |
| JP | 2013014835 | A | 1/2013 |
| WO | 2008072972 | A1 | 6/2008 |

*Primary Examiner* — Jessee Roe
(74) *Attorney, Agent, or Firm* — The Webb Law Firm

(57) ABSTRACT

A method for the practice-oriented, operationally reliable production of castings of an AlCu alloy which consists of Cu:, Mn:, Zr:, Fe:, Si:, Ti:, V:, remainder Al and unavoidable impurities. A melt which has been melted according to this alloy formula is kept at temperature for several hours and then mixed vigorously at least once. Thereafter, the melt is cast in portions into the respective casting which is then solution annealed at temperature for several hours. The casting is quenched from the solution anneal temperature to a maximum temperature of 300° C., at a specified cooling rate which the casting passes through during quenching. The casting is then artificially aged for several hours at 150-300° C. Finally, the casting is cooled to room temperature.

14 Claims, No Drawings

METHOD FOR PRODUCING COMPLEX FORMED CASTINGS AND CASTING CONSISTING OF AN ALCU ALLOY

CROSS-REFERENCE TO RELATED APPLICATIONS

This application is the United States national phase of International Application No. PCT/IB2016/000036 filed Jan. 21, 2016, and claims priority to European Patent Application No. 15151960.0 filed Jan. 21, 2015, the disclosures of which are hereby incorporated in their entirety by reference.

BACKGROUND OF THE INVENTION

Field of the Invention

The invention relates to a method for producing complex formed castings of an AlCu alloy.

Description of Related Art

When information about contents of alloy elements is provided here, said information respectively relates to the weight of the relevant alloy, unless expressly indicated otherwise.

Castings consisting of AlCu alloys of the type concerned here have particularly high strengths, especially at elevated working temperatures of more than 250° C. However, this is accompanied by poor casting characteristics which complicate the casting-production of components, which are characterized by a complex shaping.

Typical examples of such castings are cylinder heads intended for internal combustion engines which, on the one hand, are exposed to high temperatures during practical use and on the other hand have a compact construction form in which filigree-shaped form elements, such as cooling channels and oil channels, recesses, webs, guides and the like are formed.

A fundamental problem of processing substantially Si-free AlCu alloys lies in their high susceptibility to cracking under heat and in a backfeed behaviour which is much poorer than in the case of conventional AlSi alloys.

WO 2008/072972 A1 discloses a method for producing complex formed castings of an AlCu alloy which consists of (in % by weight) 2-8% Cu, 0.2-0.6% Mn, 0.07-0.3% Zr, up to 0.25% Fe, up to 0.3% Si, 0.05-0.2% Ti, up to 0.04% V and as remainder Al and unavoidable impurities, wherein the total of the contents of impurities not amounting to more than 0.1%. Particular importance is given to the presence of Zr with regard to the production of a fine structure, with grain sizes of at most 100 μm.

To improve the fineness of the casting structure, during implementation of the known method of a respectively composed melt, before casting a grain refiner such as TiC can additionally be added in a dosage of typically 2 kg per ton of melt. The casting which is obtained after casting and solidification undergoes a heat treatment in which it is initially solution annealed at 530-545° C. The casting is cooled down in an accelerated manner from the solution annealing temperature using water or in an air stream, wherein quenching with water in particular is considered as advantageous in respect of the desired high strength, but cooling in an air stream is recommended in case the casting tends to form cracks during a relatively fast cooling procedure due to its complex shaping. After the quenching, the casting is kept at a temperature of 160-240° C. for a duration of 3-14 hours to increase the hardness of the structure.

Attempts at practically implementing the known method have shown that the known alloy does admittedly have advantages regarding the material characteristics which make it particularly interesting for the casting-production of cylinder heads for internal combustion engines. However, using the known method, it is not possible to produce castings of this alloy with the required operational reliability on a large scale which meet the demands imposed on them during practical use.

Thus, it has been found that depending on the cast, the grain size of the respectively obtained castings does in fact extremely vary. Thus for example an average grain size of approximately 100 μm could be observed on a very large sample piece which solidified very slowly. However, when a smaller piece is separated from this sample, when it is again melted and is then allowed to solidify again very rapidly, then in spite of the fast solidification rate, against expectations grain sizes of 500-900 μm are found. Castings having such a coarse structure are completely unsatisfactory for the use intended by the methods concerned here.

DESCRIPTION OF THE INVENTION

In view of the prior art, it is therefore an object to provide a method which allows the production of castings of an AlCu alloy of the known type in a practice-oriented and operationally reliable manner.

With regard to the method, the invention has achieved this object in that the working steps stated herein are carried out during the production of castings of an AlCu alloy.

Thus, a method according to the invention for casting filigree-formed castings comprises the following working steps:

a) melting an AlCu alloy which consists of (in % by weight)
   Cu: 6-8%,
   Mn: 0.3-0.55%,
   Zr: 0.15-0.25%,
   Fe: up to 0.25%,
   Si: up to 0.125%,
   Ti: 0.05-0.2%,
   V: up to 0.04%,
   remainder Al and unavoidable impurities;
b) keeping the melt at a holding temperature of 730-810° C. for a holding period of 4-12 hours;
c) mixing of the melt;
d) removal of a portion of melt from the melt;
e) casting of the portion of melt removed from the melt into the casting;
f) solution annealing of the casting at a solution annealing temperature of 475-545° C. for a solution annealing period of 1-16 hours;
g) quenching of the casting from the solution annealing temperature to a maximum quenching stop temperature of 300° C., wherein the casting is quenched at least within a temperature range of 500-300° C. at a cooling rate of 0.75-15 K/s;
h) artificial ageing of the casting, wherein during artificial ageing the casting is kept at an artificial ageing temperature of 150-300° C. for a period of 1-10 hours;
i) cooling of the casting to room temperature.

The method according to the invention originates from the AlCu alloy known from the previously mentioned WO 2008/072972 A1 and provides a casting which even satisfies the highest demands imposed on its performance characteristics during practical use.

Copper is present in the alloy processed according to the invention in contents of 6-8% by weight to achieve the required high temperature strength of the casting to be produced. In respect thereof, optimum characteristics are obtained when the Cu content of the alloy processed according to the invention is 6.5-7.5% by weight.

Manganese in contents of 0.3-0.55% by weight promotes the diffusion of Cu into the Al matrix of the structure of a component produced according to the invention and thus stabilises the strength of the alloy according to the invention even at elevated operating temperatures.

This effect is achieved particularly reliably when the Mn content amounts to 0.4-0.55% by weight.

Zirconium is particularly significant for the high temperature strength of castings produced according to the invention. Thus, Zr contents of 0.15-0.25% by weight facilitate the production of disperse precipitates which, in the case of castings cast from casting alloys according to the invention, ensure that the alloy according to the invention has a fine structure, as a consequence an optimally uniform distribution of the mechanical characteristics over the volume of the casting and a minimised tendency to crack formation. These advantages can be achieved particularly reliably when the Zr content of the alloy processed according to the invention amounts to 0.18-0.25% by weight, in particular 0.2-0.25% by weight.

Iron is undesirable in an alloy according to the invention as it tends to form brittle phases. Therefore, the Fe content is restricted to a maximum of 0.25% by weight, preferably to 0.12% by weight.

The limit for the content of Si prescribed according to the invention is at most 0.125% by weight because with higher contents of Si, the risk of the formation of hot cracks increases. Adverse effects of Si on the characteristics of an alloy according to the invention can be reliably ruled out by restricting the Si content to a maximum of 0.06% by weight.

Ti in contents of 0.05-0.2% by weight, in particular 0.08-0.12% by weight, like Zr also contributes to the grain refinement. The grain refinement can also be promoted by the addition of up to 0.04% by weight of V. This applies particularly when 0.01-0.03% by weight of V are present in the alloy processed according to the invention.

The total of the contents of unavoidable impurities caused by the melting and production processes should be minimised, as in the prior art, and in particular should not exceed 0.1% by weight.

The invention is based on the understanding that in order to produce reliably defect-free complex formed castings, such as cylinder heads for petrol-driven or diesel-driven internal combustion engines, of an AlCu alloy, it is necessary to modify the parameters of the production process beyond the measures which are already known. Only in this way is it possible to produce in a procedurally reliable manner castings which are composed according to the invention and which have over their entire volume a grain size of less than 100 μm, ideally less than 80 μm.

As a first step to implement this, the melt must be kept hot within a suitable temperature range for a sufficient long period of time.

Comprehensive experiments have shown that for this purpose, a holding period of 4-12 of keeping the melt hot and a holding temperature of 730-810° C., in particular of 750-810° C., is required, wherein the desired results can be achieved in a particularly reliable manner when the holding period lasts for 6 to 10 hours and the holding temperature is 770-790° C.

Hitherto, it has not been possible to conclusively clarify the effect mechanism associated with keeping the melt within the above-mentioned time and temperature ranges, provided according to the invention (working step b) of the method according to the invention). However, here the presence of Zr, Ti and optionally V in the quantities provided according to the invention appears to have a decisive influence. These elements, together with aluminium as the main component of the alloy, form at high temperatures pre-precipitates which are activated by the long holding period and then act effectively as grain refiners.

It has also been found that it is necessary for a good casting result which remains constant over many casting procedures to thoroughly mix the melt at least once before the start of the respective casting campaign.

Subsequently, the actual casting operation begins with working step d). Working steps d)-i) of the method according to the invention are then repeated until the number of castings designated to the respective casting campaign has been produced.

If necessary, the mixing step can be repeated between two portion removals. The mixing procedure which is performed, for example as intensive stirring can be carried out in the course of a conventional degassing treatment, as is usually used in production processes of the type concerned here before the start of the actual casting operation commencing with the removal of a first portion of melt.

Furthermore, the formation of a particularly fine structure of the castings produced according to the invention can be promoted by optionally subjecting the respective portion of melt to a grain refinement treatment before it is cast into a casting, for example on the way to the casting mould. Due to a treatment of this type, when the method according to the invention is used, it is possible to produce castings for which an average grain size of the structure of less than 60 μm can be ensured.

Suitable as grain refiners which are optionally added according to the invention are the compounds which are already known for this purpose, such as TiC or TiB which in each case can be added in a dosage of 1-10 kg per ton of melt. Experiments have shown here that an optimum grain refining effect is obtained when the dosage of grain refiner is 4-8 kg per ton of melt.

In principle any conventional casting method is suitable for casting the casting (working step e) of the method according to the invention. This includes the option of a conventional gravity die-casting.

However, practical testing of the method according to the invention has shown that parts cast from the alloy processed according to the invention are sensitive to the temperature gradient which arises when they cool due to the lack of Si in their alloy, even when a fine structure in the casting has been achieved as a result of the measures carried out in the course of the preparation of the casting. This sensitivity can be counteracted by a casting method which produces a solidification which is as effectively directed as possible.

If particularly filigree-formed components having optimised characteristics are to be produced, then a so-called "dynamic casting method" should be used. This term is understood as including methods in which the casting moulds are moved while being filled with melt, on the one hand to ensure a smooth, low-turbulence inflow of the melt and, associated therewith, an equally smooth filling of the casting mould and on the other hand to achieve an optimum solidification course after the mould has been filled.

A common characteristic of the dynamic casting methods which are also known as "tilt casting methods" is that the casting mould is filled via a melt container docked thereto, in that the casting mould is rotated about a swivel axis with the melt container from a starting position in which the melt container is filled with the melt to be cast into an end position so that the melt flows into the casting mould as a result of this swivel movement. Examples of methods of this type are described in EP 1 155 763 A1, DE 10 2004 015 649 B3, DE 10 2008 015 856 A1, DE 10 2010 022 343 A1 and in German patent application DE 10 2014 102 724.8 which is hitherto unpublished.

As a result of the above-described measures (working steps a)-e) as well as the grain refinement treatment which is additionally carried out if required), following casting and solidification a casting is produced, the structure of which meets the requirement of fine grain imposed thereon (average grain size <100 μm).

To adjust its further performance characteristics, according to the invention the casting then undergoes a heat treatment in which it initially undergoes a solution annealing treatment at a solution annealing temperature of 475-545° C. for a solution annealing period of 1-16 hours. To obtain the highest possible Cu concentrations in the Al matrix and to thus exploit the full potential of the alloy, the solution temperature can be adjusted to 515-530° C.

The duration of the solution annealing treatment does not have a significant influence. It is to be set within the range according to the invention in such a way that the copper content which is present is dissolved as effectively as possible in the Al matrix. In practice, it is typically possible to dissolve at least 60% of the Cu content present, wherein it is being desired to dissolve the highest possible percentages, for example at least 70% and more of the Cu content which is present. For this purpose, during casting-production of components for internal combustion engines, a solution annealing period of 2-6 hours can be provided in practice.

After solution annealing, the respective casting is cooled in an accelerated manner from the solution annealing temperature to a maximum quenching stop temperature of 300° C. Here, the quenching rate is of vital importance.

The quenching rate is limited downwards by the fact a cooling procedure which is too slow results in strengths which are too low. Thus, it has been found that in conventional air quenching, the tensile strength and yield strength of castings consisting of the alloy processed according to the invention is lower compared to castings which consist of standard alloys. Therefore, in working step g), the invention provides a quenching rate of in average at least 0.75 K/s over the entire casting.

In contrast, if the casting is cooled too rapidly after solution annealing, there is a risk of cracks developing. They can, for example, appear if the casting is quenched in water which is at a temperature of below 70° C. and is applied as a jet, a gush or in a dip tank. Crack formation can be avoided with sufficient reliability by quenching the casting with water heated to at least 70° C.

Alternatively, it is also possible to carry out quenching with an atomised spray. During atomised spray quenching, cooling takes place so gently that cracks do not form if the atomised spray is delivered at room temperature.

Regardless of how the quenching is executed, according to the invention, in order to avoid crack formation, the upper limit of the quenching rate, achieved on average over the entire casting in the quenching procedure carried out according to the invention in working step g) of the method according to the invention is restricted to 15 K/s.

An average cooling rate, achieved over the entire casting, of 1.5-7.5 K/s is ideal. For example, water quenching with hot water at 90° C. results in a cooling rate of approximately 7.5 K/s and it led to the best results when the method according to the invention was tested.

As mentioned, the quenching medium can be applied as a gush or as an atomised spray. The use of atomised spray cooling makes it possible to cool the castings by impacting them on the outside or from the inside in that the quenching medium is guided through channels present in the casting, for example in the case of a cylinder head through the water jacket. Measures which are possible here are described, for example in DE 102 22 098 B4. In the case of cooling from outside, the cooling rate is approximately 2-2.5 K/s, in the case of internal quenching, the quenching rates are 1.5-3.75 K/s.

In working step g), the casting is quenched to a temperature which is less than or equal to the subsequent ageing temperature. According to the invention, the artificial ageing lasts 1 to 10 hours at an artificial ageing temperature of 150-300° C., in particular 200-260° C. Thus, the artificial ageing is carried out based on the conventional procedure, however, unlike that procedure, the invention explicitly does not include an over-ageing.

The duration of the artificial ageing has no significant effect on the result of the treatment. However, to achieve a stable state of the casting, it has proved to be suitable to carry out the ageing procedure over a period of at least 2 hours. In a practice-oriented embodiment, the period provided for artificial ageing is typically 2-4 hours.

Thus, castings produced according to the invention are characterized in that they consist of an AlCu alloy with (in % by weight) 6-8% Cu, 0.3-0.55% Mn, 0.15-0.25% Zr, up to 0.25% Fe, up to 0.125% Si, 0.05-0.2% Ti, up to 0.04% V and as remainder Al and unavoidable impurities and they have a structure which has an average grain size of less than 100 μm, in particular less than 80 μm.

Castings produced and constituted according to the invention, with a minimised susceptibility to form cracks even after being used for at least 400 h at temperatures of at least 250° C., as they are typical for applications in internal combustion engines for automobiles, have a tensile strength at a test temperature of 250° C. of at least 160 MPa, typically at least 200 MPa, and a yield strength of at least 100 MPa, typically at least 150 MPa.

In the following, the invention will be described in more detail on the basis of embodiments.

To test the method according to the invention, test melts S1,S2,S3 were melted in a conventional melting furnace, the compositions of said melts being provided in Table 1.

Each of the melts S1,S2,S3 was kept in the melting furnace for a period tH at a holding temperature TH.

Then, before the start of the actual casting campaign, a conventional degassing treatment was carried out in which the respective melt S1,S2,S3 was additionally stirred vigorously to achieve a mixing.

In the respective casting campaign which commenced thereafter, the castings G1-G4 (melt S1), G5 (melt S2) and castings G6,G7 (melt S3) were cast from the melts S1, S2, S3. The castings G1-G5 were cylinder heads for diesel internal combustion engines, while the castings G6,G7 to be cast were cylinder heads for petrol-driven internal combustion engines.

In the respective casting campaign, adequately calculated portions of the respective melt S1, S2, S3 were removed from the melting furnace using a conventional casting ladle for casting the castings G1-G7.

TiB was respectively added in a dosage DKF to the portion of melt contained in the casting ladle.

The respective portion of melt was cast using the rotational casting method known as "Rotacast" in a conventional rotational casting machine, as described for example in EP 1 155 763 Al.

After solidification and demoulding, the obtained castings were solution annealed at a solution annealing temperature TLG for a solution annealing period tLG.

TABLE 1

Values in % by weight, remainder Al and unavoidable impurities

| Melt | Cu | Mn | Zr | Fe | Si | Ti | V | Acc. to invention? |
|---|---|---|---|---|---|---|---|---|
| S1 | 6.52 | 0.455 | 0.206 | 0.074 | 0.095 | 0.086 | 0.0093 | yes |
| S2 | 6.34 | 0.433 | 0.189 | 0.094 | 0.10 | 0.085 | 0.0095 | yes |
| S3 | 6.47 | 0.453 | 0.198 | 0.089 | 0.051 | 0.091 | 0.0101 | yes |

TABLE 2

| Casting | Melt | TH [° C.] | tH [Hours] | DKF [kg per ton of melt] | TLG [° C.] | tLG [Hours] | TAS [° C.] | dAS [K/s] | TWA [° C.] | tWA [Hours] | According to the invention? |
|---|---|---|---|---|---|---|---|---|---|---|---|
| G1 | S1 | 780 | 12 | 8 | 530 | 4 | 100 | 6.9 | 240 | 4 | yes |
| G2 | S1 | 780 | 12 | 8 | 530 | 4 | 100 | 13.8 | 240 | 4 | yes |
| G3 | S1 | 780 | 12 | 8 | 530 | 4 | 150 | 0.70 | 240 | 4 | no |
| G4 | S1 | 780 | 12 | 8 | 530 | 4 | 150 | 2.45 | 240 | 4 | yes |
| G5 | S2 | 775 | 8 | 7 | 530 | 4.5 | 75 | 2.03 | 240 | 4 | yes |
| G6 | S3 | 779 | 8.5 | 8 | 530 | 4 | 90 | 7.5 | 240 | 4 | yes |
| G7 | S3 | 779 | 8.5 | 8 | 530 | 4 | 90 | 7.5 | 240 | 4 | yes |

After the completion of the solution annealing, the castings were quenched from the respective solution annealing temperature TLG to a quenching stop temperature TAS at a cooling rate dAS.

Thereafter, the castings G1-G7 were subjected to artificial ageing. In the course of this, the castings were kept at the respective artificial ageing temperature TWA for a period tWA.

Stated in Table 2 for each of the castings G1-G7 obtained in this way are the melt from which they were respectively cast as well as the parameters of holding period tH, holding temperature TH, dosage DKF, solution annealing temperature TLG, solution annealing period tLG, quenching stop temperature TAS, cooling rate dAS, artificial ageing period tWA and artificial ageing temperature TWA.

The average grain size, determined after cooling at room temperature, of the structure, tensile strength Rm, yield strength Rp0.2 and expansion A are listed in Table 3.

It is found that the casting G3 quenched after solution annealing at too low a cooling rate dAS has achieved a significantly lower tensile strength Rm and likewise a significantly lower yield strength Rp0.2 compared to the heat-treated castings G1,G2 and G4 according to the invention which were cast from the same melt S1.

Thus, the invention provides a method for the practice-oriented, operationally reliable production of castings of an AlCu alloy which consists of (in % by weight) Cu: 6-8%, Mn: 0.3-0.55%, Zr: 0.15-0.25%, Fe: up to 0.25%, Si: up to 0.125%, Ti: 0.05-0.2%, V: up to 0.04%, remainder Al and unavoidable impurities. A melt which has been melted according to this alloy formula is kept at 730-810° C. for a period of 4-12 hours and then mixed thoroughly and vigorously at least once. Thereafter, the melt is cast in portions into the respective casting which is then solution annealed at 475-545° C. for a period of 1-16 hours. The casting is quenched from the solution anneal temperature to a maximum temperature of 300° C., the cooling rate being 0.75-15 K/s in the temperature range of 500-300° C. which the casting passes through during quenching. The casting is then artificially aged for 1 to 10 hours at 150-300° C. Finally, the casting is cooled to room temperature.

TABLE 3

| Casting | Average grain size [μm] | Rm [MPa] | Rp0.2 [MPa] | A [%] | According to the invention? |
|---|---|---|---|---|---|
| G1 | 53.0 | 324 | 203 | 3.89 | yes |
| G2 | 54.3 | 333 | 218 | 3.43 | yes |
| G3 | 52.8 | 270 | 137 | 7.03 | no |
| G4 | 55.2 | 297 | 173 | 4.58 | yes |
| G5 | 46.5 | 336 | 212 | 4.79 | yes |
| G6 | 39.5 | 329 | 196 | 4.99 | yes |
| G7 | 36.8 | 329 | 198 | 5.55 | yes |

The invention claimed is:

1. A method for producing complex formed castings comprising the following working steps:

a) melting an AlCu alloy which consists of (in % by weight)
Cu: 6-8%,
Mn: 0.3-0.55%,
Zr: 0.15-0.25%,
Fe: up to 0.25%,
Si: up to 0.125%,
Ti: 0.05-0.2%,
V: up to 0.04%,
remainder Al and unavoidable impurities;

b) keeping the melt at a holding temperature of 730-810° C. for a holding period of 4-12 hours;

c) mixing of the melt;

d) removing a portion of melt from the melt;

e) casting of the portion of melt removed from the melt into the casting;

f) solution annealing of the casting at a solution annealing temperature of 475-545° C. for a solution annealing period of 1-165 hours;

g) quenching of the casting from the solution annealing temperature to a maximum quenching stop temperature of 300° C., wherein the casting is quenched at least within a temperature range of 300° C. to 500° C. at a cooling rate of 0.75-15 K/s;

h) artificial ageing of the casting, wherein during artificial ageing the casting is kept at an artificial ageing temperature of 150-300° C. for a period of 1-10 hours;

i) cooling of the casting to room temperature.

2. The method according to claim 1, wherein the portion of melt removed from the melt undergoes a grain refinement treatment before being cast into the casting.

3. The method according to claim 2, wherein for the grain refinement treatment, TiC or TiB is added as a grain refiner in a dosage of 1-10 kg per ton of melt.

4. The method according to claim 3, wherein the dosage is 4-8 kg per ton of melt.

5. The method according to claim 1, wherein a dynamic casting method is used when casting the portion of melt into the casting.

6. The method according to claim 1, wherein the holding period (working step b) lasts 6-10 hours.

7. The method according to claim 1, wherein the holding temperature (working step b) is 770-790° C.

8. The method according to claim 1, wherein the mixing (working step c) is carried out in a course of a degassing treatment of the melt.

9. The method according to claim 1, wherein the solution annealing temperature is 515-530° C.

10. The method according to claim 1, wherein the solution annealing period lasts 2-6 hours.

11. The method according to claim 1, wherein for the quenching of the casting (working step g), a quenching medium is used which is heated to a temperature of at least 70° C.

12. The method according to claim 11, wherein the quenching medium is directed onto the casting as an atomised spray.

13. The method according to claim 1, wherein the artificial ageing temperature is 200-260° C.

14. The method according to claim 1, wherein the artificial ageing period (working step h) is 2-4 hours.

* * * * *